US005722336A

United States Patent [19]

Takeuchi

[11] Patent Number: 5,722,336

[45] Date of Patent: Mar. 3, 1998

[54] SKIN FOAM-IN-PLACE FORMING SKIN MATERIAL AND SKIN FOAM-IN-PLACE FOAMED PRODUCT

[75] Inventor: Nobuo Takeuchi, Aichi, Japan

[73] Assignee: INOAC Corporation, Nagoya, Japan

[21] Appl. No.: 649,441

[22] Filed: May 17, 1996

[30] Foreign Application Priority Data

May 17, 1995 [JP] Japan ..... 7-144104

[51] Int. Cl.[6] ..... D05B 15/00; B68G 07/10; B68G 11/04

[52] U.S. Cl. ..... 112/441; 112/420.27; 112/162; 112/475.26; 264/46.6; 297/452.57

[58] Field of Search ..... 112/441, 438, 112/83, 10, 470.24, 475.24, 475.26, 162, 176, 177; 428/304.4, 215, 318.6, 91, 319.3, 74; 264/46.6, 46.7, 45.1, 259, 135, 45.5; 297/452.62, 452.48, 452.57

[56] References Cited

U.S. PATENT DOCUMENTS

| | | | |
|---|---|---|---|
| 832,740 | 10/1906 | Maier | 112/475.26 X |
| 3,431,876 | 3/1969 | Russell | 112/475.26 X |
| 4,578,300 | 3/1986 | Merlet | 428/91 |
| 4,580,514 | 4/1986 | Hanyu et al. | 112/162 |
| 4,781,976 | 11/1988 | Fujita et al. | 428/318.6 |
| 4,987,666 | 1/1991 | Smith | 264/46.8 X |
| 5,130,074 | 7/1992 | Sakamoto et al. | 264/259 |

FOREIGN PATENT DOCUMENTS

| | | |
|---|---|---|
| 3-266611 | 11/1991 | Japan . |
| 5-83503 | 11/1993 | Japan . |

*Primary Examiner*—Ismael Izaguirre

*Attorney, Agent, or Firm*—Sughrue, Mion, Zinn, Macpeak & Seas, PLLC

[57] ABSTRACT

A skin foam-in-place skin material is prepared by stitching a plurality of skin forming pieces into a predetermined shape. End edges of the skin forming pieces made of moquette skin are overlapped one upon another. The overlapped portion is joined together by over-lock stitches at a stitching pitch ranging from 1.5 to 3.0 mm using a single needle and three threads along the end edge.

14 Claims, 4 Drawing Sheets

SKIN FOAM-IN-PLACE FORMING SKIN MATERIAL AND SKIN FOAM-IN-PLACE FOAMED PRODUCT

BACKGROUND OF THE INVENTION

1. Field of the Invention

The present invention relates to a skin foam-in-place skin material prepared by stitching a plurality of skin forming pieces and a skin foam-in-place foamed product using such skin foam-in-place foaming skin material.

2. Description of the Related Art

Skin foam-in-place foaming is performed by a method involving the steps of arranging a skin foam-in-place foaming skin material (hereinafter the "skin material"); inside a mold and charging a liquid foaming material into the skin material to allow the foaming material to foam integrally with the skin material. This method is advantageous in that not only the operation of attaching the skin material to the surface of the foamed body can be dispensed with but also the skin material does not separate itself from the foamed body since the skin material and the foamed body are foamed in place together. Hence, the wrinkling or the like of the skin material can be prevented. Therefore, skin foam-in-place foaming has extensively been employed as a method for fabricating foamed products whose surface is covered with a skin material.

Many skin materials that have heretofore been used for such skin foam-in-place foaming include: plastic leather products prepared into a predetermined shape by vacuum forming, slush molding, or the like; or those prepared by stitching a plurality of skin forming pieces together, each being made of fabric or the like.

A recent trend is that skin materials made of fabric are preferred to plastic laser products in terms of aesthetic appeal and surface touch, and this trend has been sustained by the dominant use of the skin foam-in-place foaming skin materials prepared by stitching the plurality of skin forming pieces together. An exemplary fabric-based skin material is prepared by stitching together a three-layered skin material made of fabric skin, urethane slab, and polyurethane film in order to prevent leakage from the material.

When the liquid foaming material is charged into the fabric-based skin material to be foamed, the foaming material leaks outside through the needle holes in the seams formed by the conventional lock stitching.

In order to overcome this problem, methods of preventing the leakage at the time of foaming have been proposed of sticking a urethane tape to the stitched portion before foaming (Japanese Patent Examined Publication No. Hei. 5-83503), or by closing the needle holes in the seams with an adhesive. Further, the Applicant has disclosed the art of controlling the leakage of the foaming material from the needle holes by multi-thread chain stitching (Japanese Patent Unexamined Publication No. Hei. 3-266611).

The multi-thread chain stitching technique does exhibit excellent effects on the three-layered skin material, but is not so effective when applied to other types of skin materials. That is, when multi-thread chain stitching is applied to a single-layered skin material made of fabric skin, or to a double-layered skin material made of fabric skin and resin film such as polyurethane film or polyvinyl chloride film, the foaming material leaks from the needle holes even if these skin materials are multi-thread-chain-stitched. Therefore, in using such skin materials, one cannot but employ the method of using urethane tapes or adhesives, which in turn increases not only the number of operation steps but also the labor of preparing auxiliary materials such as urethane tapes or the like.

SUMMARY OF THE INVENTION

The present invention has been made to overcome the aforementioned problems, and therefore an object of the invention is to provide a skin foam-in-place foaming skin material and a skin foam-in-place foamed product, the skin material allowing a foaming material to be directly charged into the stitched skin material without any leakage or like inconvenience, without having to attach a urethane tape or to apply an adhesive even if the skin material is single-layered or double-layered.

To achieve the above object, a first aspect of the invention is applied to a skin foam-in-place foaming skin material that is prepared into a predetermined shape by stitching a plurality of skin forming pieces together. The end edges of such skin forming pieces are overlapped one upon another, and the overlapped portion is stitched by over-lock stitching (over-edge chain stitching) along the end edges.

A second aspect of the invention is applied to a skin foam-in-place foaming skin material, in which each skin forming piece according to the first aspect of the invention is made of moquette skin and is over-lock-stitched using a single needle and three threads at a stitching pitch ranging from 1.5 to 3.0 mm.

A third aspect of the invention is applied to a skin foam-in-place foaming skin material, in which a foamed body is formed integrally with the skin foam-in-place foaming skin material, according to the first and the second aspect of the invention, inside the skin foam-in-place foaming skin material.

In preparing a skin foam-in-place foamed product, the skin material is expanded by foaming pressure derived from foaming. As the skin material continues to expand, a tensile force such cause meshes to expand is developed at the seams. If the seams are over-lock-stitched as in the case of the skin foam-in-place foaming skin material and the skin foam-in-place foamed product of the invention, the sewing thread extends (i.e., looped, engaged, etc) doubly in forming stitches as a whole, which in turn scatters the tensile force applied to the sewing thread forming the stitches even if the tensile force is applied by foaming pressure, and makes the stitches hard to open. As a result, the foaming material is hard to leak through the needle holes.

According to the second aspect of the invention, when the skin place-in place foaming skin material is prepared by over-lock stitching at a stitching pitch ranging from 1.5 to 3.0 mm, the tensile force is scattered into a larger number of sewing threads forming the stitches, which in turn prevents the needle holes from being expanded and therefore completely prevents the leakage of the foaming material. If a moquette skin back-coated with resin is used as a skin forming piece, the leakage of the foaming material from the texture can be prevented even if a single-layered fabric skin is used, since the meshes are close-packed over the entire part of the texture.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

A description will be given in more detail of embodiments of the invention with reference to the accompanying drawings.

(Embodiment 1)

(1) Construction of skin foam-in-place foaming skin material

FIGS. 1 to 6 show a skin foam-in-place foaming skin material (hereinafter referred to simply as the "skin material") and a skin foam-in-place foamed product, which are embodiments of the invention. These embodiments are applied to a head rest for an automobile as a skin foam-in-place foamed product.

Figure 1:
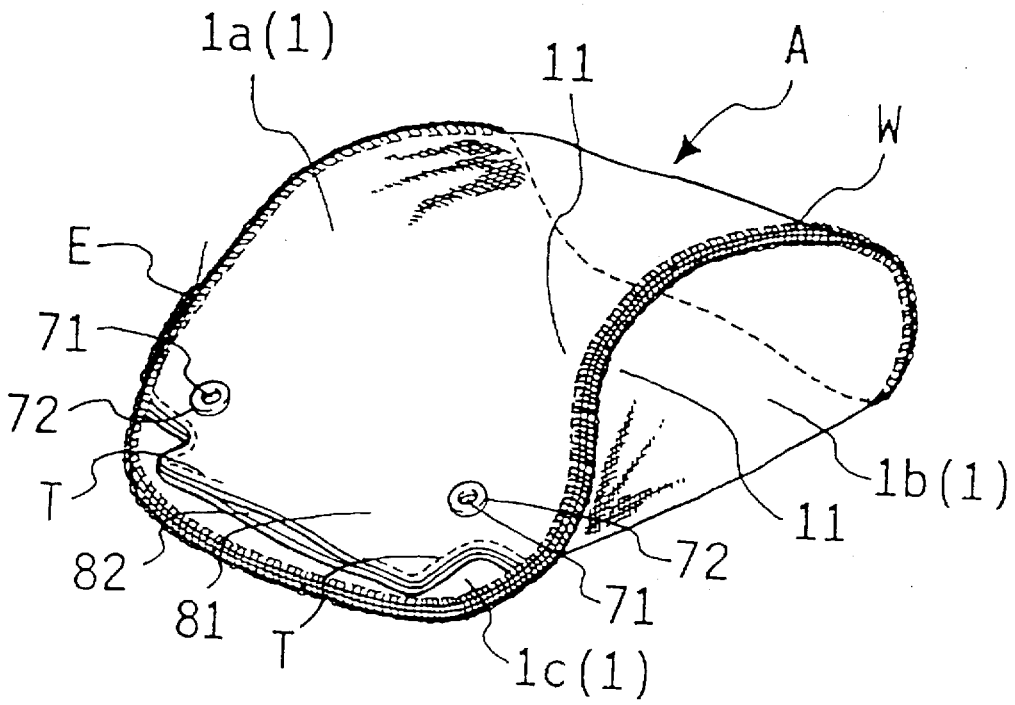
FIG. 1 is a perspective view showing a skin material according to an embodiment of the invention.
Figure 2:
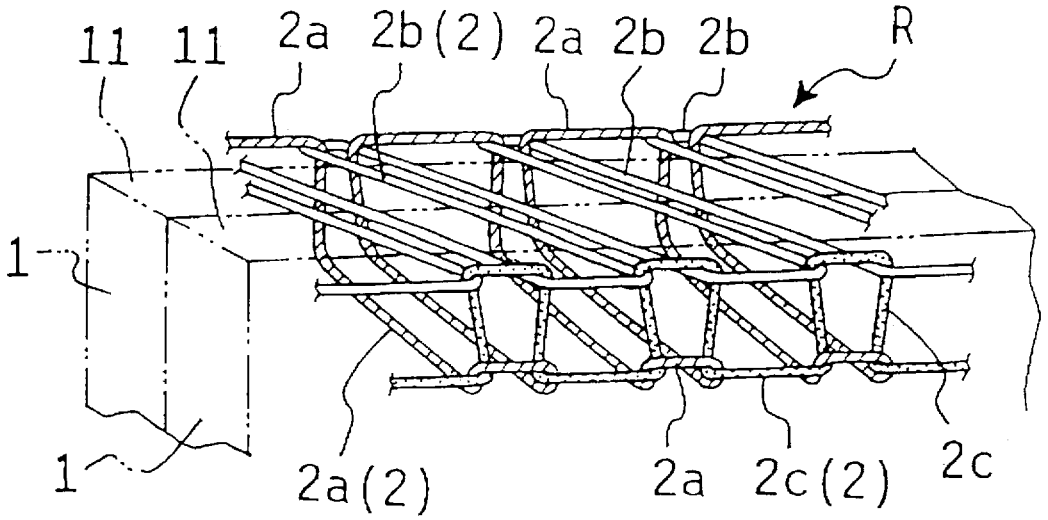
FIG. 2 is a partially enlarged perspective view showing over-lock stitches in the vicinity of an end edge.
Figure 3:
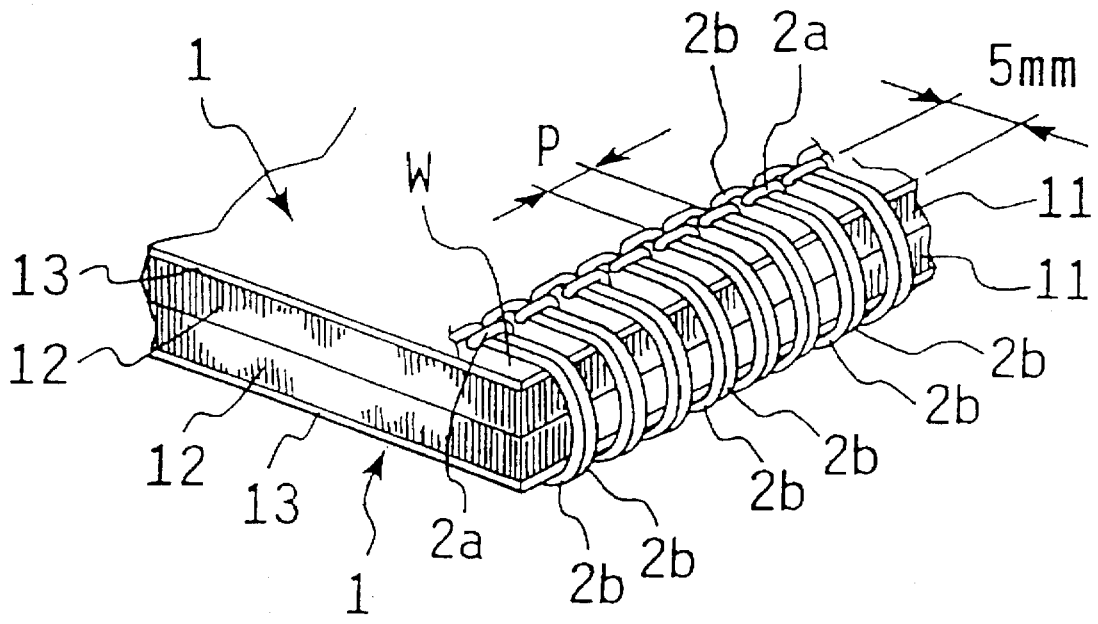
FIG. 3 is a partially enlarged perspective view showing a stitched condition in the vicinity of an end edge.
Figure 4:
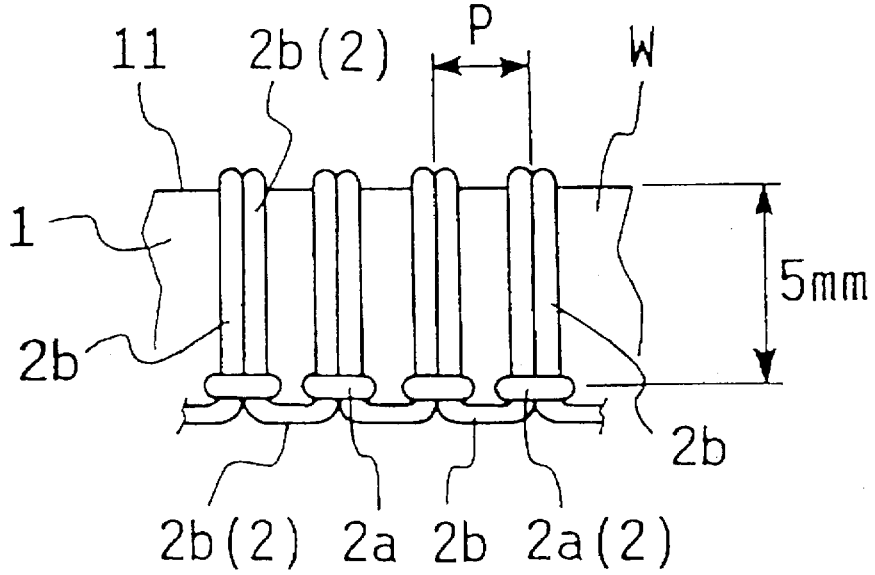
FIG. 4 is a plan view showing the stitched condition of FIG. 3.
Figure 5:
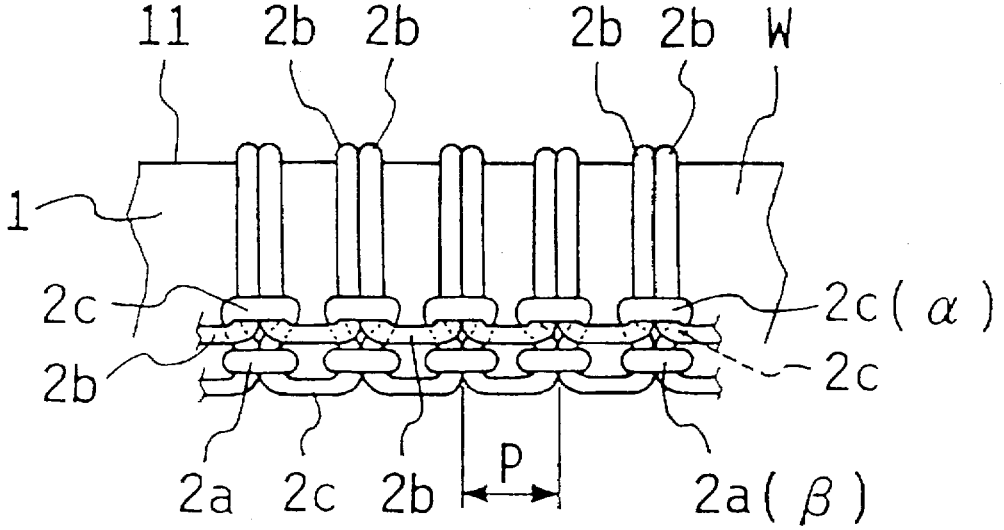
FIG. 5 is a rear view showing the stitched condition of FIG. 3.
Figure 6A:
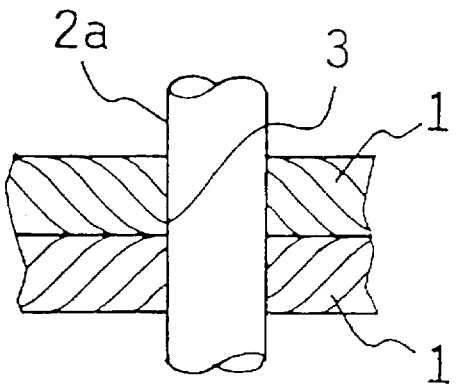
FIGS. 6A and 6B are sectional views illustrative of conditions in which a tensile force is applied by foaming pressure.
Figure 6B:
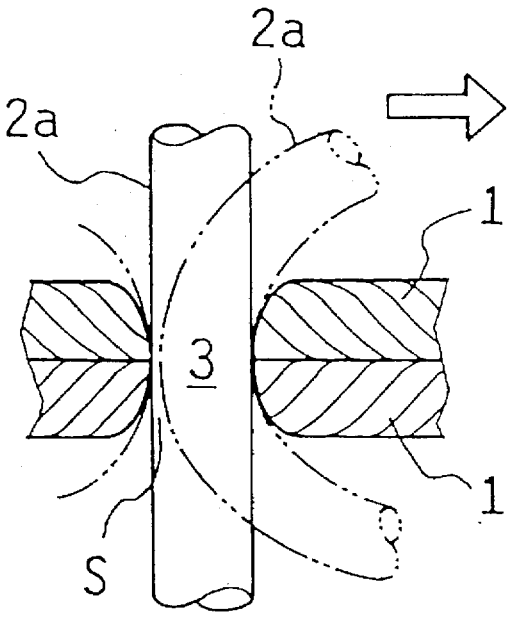

FIG. 1 is a perspective view of a skin material; FIGS. 2 and 3 are perspective views showing over-lock stitches in the vicinity of end edges; FIG. 4 is a plan view of FIG. 3; FIG. 5 is a rear view of FIG. 3; and FIGS. 6A and 6B are sectional views illustrative of a condition in which a tensile force is applied by foaming pressure.

As shown in FIG. 1, a skin material A is formed by stitching three skin forming pieces 1*a*, 1*b* and 1*c* together into a pillow-like cubic shape. Each of the skin forming pieces 1 forms the pillow-like shape by overlapping end edges 11 thereof and by stitching the entire part of the end edges 11 with over-lock stitches R. It may be noted that the skin material A is arranged inside out with respect to the condition shown in FIG. 1 when subjected to a skin foam-in-place foaming process.

Reference numeral 71 denotes stay holes through which a stay portion of an insert (not shown) protrude out from the inside of the skin material A, respectively; and 72, a ring for holding the stay. The ring 72 is stuck to the skin forming piece 1. Reference numeral 81 denotes a tongue, which is so designed as to be arranged inside a foamed body when the skin foam-in-place foamed product has been completed. The tongue 81 is stitched from the over-lock-stitched peripheral edge portion toward a middle portion, with the middle portion being opening to form a slit 82. The slit 82 serves not only as a foaming material charging inlet but also as an insert inserting inlet.

Each skin forming piece 1 is a cut pile fabric formed of a synthetic fiber such as acrylic or polyamide (polyester fiber in this embodiment) as a pile yarn 12, and of cotton or rayon as a warp. The back of cut pile fabric is coated with a resin-coating of 50 to 70 g in order to prevent the thread from being frayed, thereby resulting in a missing plush loop of the cut pile fabric. It may be noted that a quantity of air permeated through a fabric (JIS L1096 as specified in rule A of air permeability) is about 0.08 to 0.20 $cm^3/cm^2/sec$. Since the back of the skin forming piece is covered with a coated layer 13, the foaming material is hard to leak through the texture of the fabric, as shown in FIG. 3.

Although the end edges of the skin forming pieces 1 are overlapped one upon another to form a bag-like head rest, the peripheral edge forming portion is stitched by the over-lock stitches R (or also called "over-edge chain stitches") as shown in FIG. 2. The stitches extend along all the periphery, and the stitching end portion E is stitched twice to prevent the undoing of the seam as shown in FIG. 1.

Over-edge chain stitching with blind over edging is employed as a stitching form and performed with a single needle and three threads (JIS B9070). As shown in FIG. 2, the over-lock stitches are formed by three sewing threads 2*a*, 2*b* and 2*c*. Only the sewing thread 2*a* passes through the two skin forming pieces 1 at a position about 5 mm inward from the end edge 11 of the skin forming piece 1 as shown in FIG. 4. The sewing thread 2*b* firmly ties the end edge 11 around and engages with the sewing threads 2*a* and 2*c* lest the end edge should open apart. The sewing thread 2*a* passing through a needle hole 3 and the sewing thread 2*b* tying the end edge 11 around are all doubled, excluding portions at which these sewing threads engage with their counterpart sewing threads as shown in FIGS. 2 to 5.

FIG. 2 shows loosely entangled sewing threads in schematic form to indicate the relationship among the sewing threads 2. FIGS. 3 to 5 show portions stitched at a large stitching pitch P to facilitate the understanding. However, the stitches are in actuality more closely packed. An engagement tightening loop $\alpha$ and a stitch $\beta$ are in actuality more or less closer to each other.

The stitching pitch P is preferred to range from 1.5 to 3 mm, or more preferably from 1.5 to 2 mm. The reason is that it is technically difficult to stitch at a stitching pitch P smaller than 1.5 mm, and that if the stitching pitch P exceeds 2 mm, a tensile force derived from foaming pressure is applied to every stitch, which gradually increases the load applied to the sewing thread 2*a* and thus brings about some inconvenience. When the stitching pitch P exceeds 3 mm, it has been verified that the foaming material leaks through the needle holes 3. Although how the leakage takes place is not specifically known, it is assumed that, e.g., the following leaking mechanism takes place.

The skin material A is expanded by foaming pressure at the time of foaming. Since the skin forming pieces 1 extend, a tensile force is applied to the stitches of the skin material. As long as the stitching pitch P is small, the sewing thread 2*a* is closely arranged, which increases the number of sewing threads 2*a* per unit length. As a result, the tensile force is scattered, which in turn allows the sewing thread 2*a* to be upright in the needle hole 3 direction as shown in FIG. 6A. However, if the stitching pitch P is increased, the tensile load applied to the sewing thread 2*a* is increased, which in turn causes the sewing thread 2*a* to be pulled in an undesired direction as shown in FIG. 6B. As a result, the needle hole 3 is deformed to form a gap S between the sewing thread 2*a* and the needle hole 3, so that the foaming material starts leaking from such gap S.

In this embodiment, the over-lock stitches are formed using a polyester thread #8 in size and a sewing machine needle #16 in size. By using the sewing thread 2 which is thicker than the hole 3 of the sewing machine needle, the leakage of the foaming material outside through the needle hole 3 at the time of foaming is controlled. Since it is effective to prevent the leakage of the foaming material if the outer diameter of the sewing thread 2*a* is larger than the diameter of the needle hole, it is preferred to set the outer diameter of the sewing thread to the largest possible value, although a thicker sewing thread suffers from the problem of stitching difficulties.

It may be noted that the seam T from the over-lock-stitched peripheral edge toward the tongue 81 is prepared by line stitching (lock-stitching), although only in part. Hence, the needle holes at the seam T are sealed up with an adhesive or the like prior to foaming.

(2) Skin foam-in-place foamed products and their evaluation test

Skin foam-in-place foamed products prepared using the aforementioned skin material will be described next.

The skin foam-in-place foamed product is prepared by first putting the skin material A shown in FIG. 1 inside out and then inserting an insert into the skin material. More specifically, not only the insert base portion is set inside the skin material, but also the stays are caused to pass through the stay holes 71 so that the stays are arranged on the outer surface of the skin material A. A liquid foaming material such as a polyurethane foam agent is thereafter charged into the skin material through the slit 82. The thus prepared body is set in the foaming mold, and a desired skin foam-in-place foamed product (head rest) is obtained by foaming.

The thus prepared skin foam-in-place foamed products were subjected to an evaluation test. Skin materials A prepared as test pieces and comparative pieces had such shape as shown in FIG. 1 and were stitched using basically the same sewing threads 2 and sewing needle with the stitching types and stitching pitches made different.

Test pieces 1 to 4 were over-lock-stitched at stitching pitches P of 1.5, 2, 3, and 4 mm. Comparative pieces 1 to 3 were lock-stitched at stitching pitches of 1, 2, and 3 mm. Comparative pieces 4 to 6 were multi-thread-chain-stitched at stitching pitches of 1, 2, and 3 mm.

These test and comparative pieces were evaluated at four different levels in terms of the quantity of foaming material leaked. The term "Excellent" is given to satisfactory pieces with no leakage of foaming material. The term "Good" is given to pieces that were acceptable although these pieces were not as satisfactory as the pieces indicated by the term "Excellent". The pieces indicated by the term "Good" exhibited either no leakage or little leakage. The term "Poor" is given to unsatisfactory pieces with the foaming material leaking in medium quantities. The term "Very Poor" is given also to unsatisfactory pieces with the foaming material leaking in large quantities. The test results are shown in Table 1.

TABLE 1

| Stitching Type | Sample | Stitching Pitch | Result (Leak Degree) | Remarks |
|---|---|---|---|---|
| Over-locking Stitching (Embodiment 1) | Example 1 | 1.5 mm | Excellent | |
| | Example 2 | 2 mm | Excellent | |
| | Example 3 | 3 mm | Good | |
| | Example 4 | 4 mm | Poor | |
| Line Stitching | Comparative Piece 1 | 1 mm | Very Poor | |
| | Comparative Piece 2 | 2 mm | Very Poor | |
| | Comparative Piece 3 | 3 mm | Very Poor | |
| Multi-thread-chain-stitching | Comparative Piece 4 | 1 mm | — | Impossible to stitch |
| | Comparative Piece 5 | 2 mm | Poor | |
| | Comparative Piece 6 | 3 mm | Poor | |

According to the over-lock stitching of the embodiment, extremely satisfactory results were obtained by the product pieces stitched at stitching pitches P of 1.5 mm and 2 mm. Even the product pieces over-lock-stitched at a pitch P of 3 mm exhibited acceptable results. However, it was difficult to completely block the leakage of the foaming material. The product pieces over-lock-stitched at a pitch P of 4 mm were unsatisfactory.

On the other hand, all the lock-stitched comparative pieces 1 to 3 exhibited the leakage of foaming material in large quantities and were therefore unsatisfactory. The multi-thread-chain-stitched comparative pieces 5 and 6 exhibited less leakage of foaming material in less quantities but were also unsatisfactory. It may be noted that it was not possible to stitch the comparative piece 4 and that the comparative piece 4 was not counted as a piece qualified for the evaluation test. The leakage of the foaming material from stitches was not observed in all skin materials.

Then, evaluation test was carried out using double-layered skin forming pieces made of fabric skin or resin film such as polyurethane film or polyvinyl chloride film. Results similar to the above were obtained.

(Embodiment 2)

Figure 7:
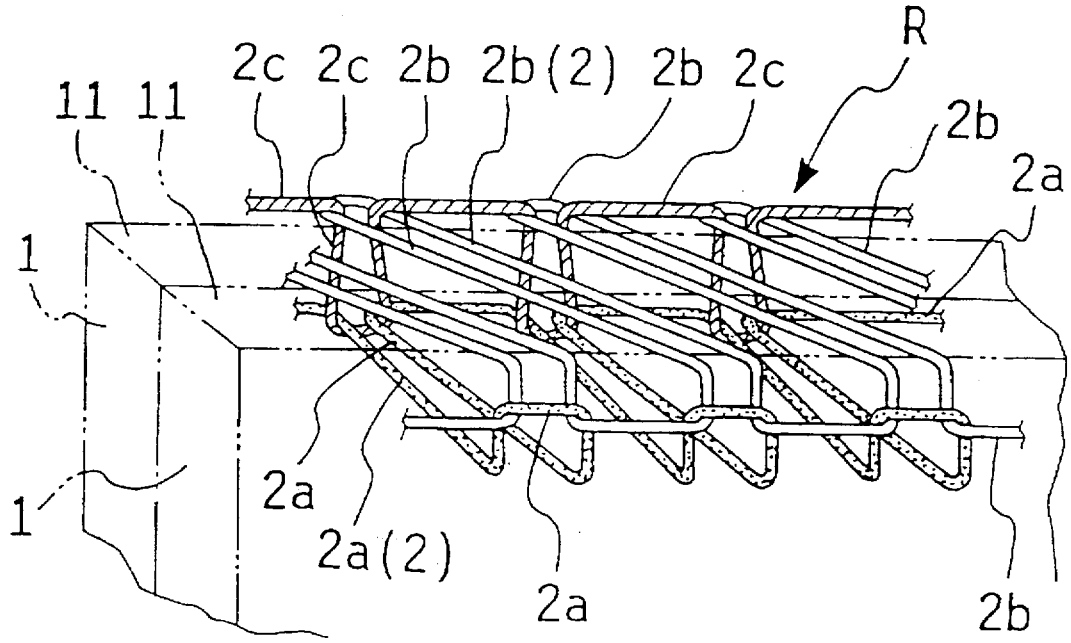
FIG. 7 is a partially enlarged perspective view showing over-lock stitches in the vicinity of an end edge in a second embodiment.

Over-lock stitching such as shown in FIG. 7 is employed in Embodiment 2. Over-edge chain stitching with a single needle and three threads is employed as the stitching type. Results similar to Embodiment 1 were obtained in Embodiment 2.

Although the pieces over-lock-stitched with a single needle and two threads exhibited foaming material leakage preventing capability, the level of such capability was impaired. It is verified that pieces over-lock-stitched with a single needle and single thread also exhibited foaming material leakage preventing capability but that the level of such capability was further impaired.

When a skin foam-in-place foamed product was fabricated using a skin foam-in-place foaming skin material prepared by over-lock stitching according to the above-mentioned embodiment, the leakage of the foaming material can be prevented without sticking a urethane tape nor applying an adhesive to the needle holes. Therefore, auxiliary materials such as urethane tapes or the like can be dispensed with. Further, the operation of sticking the urethane tape or the like can be dispensed with, which in turn contributes to the labor-saving.

Over-lock stitching is effective in controlling the deformation of the stitches against a tensile force derived from foaming pressure, with the sewing thread **2*b* stabilizing the stitches formed by the sewing thread 2*a* in the needle hole and with the sewing thread 2*c* engaged with the sewing threads 2*a*, 2*b*. Helped by the reinforced stitching (as if the material were stitched twice), the sewing thread 2*a*** keeps the initial tightened condition without increasing the size of each needle hole. In the case of over-lock stitching with a single needle and three threads at a stitching pitch ranging from 1.5 to 3.0 mm in particular, acceptable, satisfactory results can be obtained reliably. Products prepared at a stitching pitch ranging from 1.5 to 2.0 mm do not leak the foaming material outside the skin material at all, which in turn contributes to improving the quality of skin foam-in-place foamed products.

The application of the invention is not limited to the aforementioned embodiments, but may be modified in various modes according to the object and use within the scope of the invention. The shape and material of the skin forming piece 1, the material and size of the sewing thread 2, and the like can be selected appropriately. The invention is, of course, applicable to three-layered skin materials. The application of the skin foam-in-place foamed product is not limited to head rests, but to various other types of skin foam-in-place foamed products.

The skin foam-in-place foaming skin material and the skin foam-in-place foamed product of the invention are characterized as using a single-layered or double-layered skin material and controlling the leakage of the foaming material from the needle holes even if the foaming material is directly charged into the skin material. Therefore, the invention can provide excellent advantages of not only improving the productivity of the skin foam-in-place foamed product but also stabilizing and maintaining the quality thereof.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A skin foam-in-place skin material, comprising:

a plurality of skin forming pieces being stitched into a predetermined shape so that end edges of said skin forming pieces are overlapped one upon another; and a plurality of threads by which the overlapped portion of said skin forming pieces is over-edge chain stitched with blind over edging along the end edges thereof, to prevent leakage through the end edges.

2. A skin foam-in-place skin material as claimed in claim 1, wherein said skin forming pieces are made of moquette skin.

3. A skin foam-in-place skin material as claimed in claim 1, wherein said threads comprises three threads.

4. A skin foam-in-place skin material as claimed in claim 1, wherein the overlapped portion of said skin forming pieces is over-edge chain stitched with blind edging at a stitching pitch ranging from 1.5 to 3 mm.

5. A skin foam-in-place skin material as claimed in claim 1, wherein the overlapped portion of said skin forming pieces is over-edge chain stitched in the blind edging at a stitching pitch ranging from 1.5 to 2 mm.

6. A skin foam-in-place skin material according to claim 1, wherein said skin forming pieces are made of moquette skin and is over-edge chain stitched with blind edging by three of said threads using a single needle at a stitching pitch ranging from 1.5 to 3.0 mm.

7. A skin foam-in-place skin material as claimed in claim 1, wherein an outer diameter of said threads is larger than a diameter of needle holes.

8. A skin foam-in-place skin material as claimed in claim 1, further comprising a resin coating formed on a rear surface of said skin forming pieces.

9. A skin foam-in-place foamed product, comprising:

a plurality of skin forming pieces being stitched into a predetermined shape so that end edges of said skin forming pieces are overlapped one upon another;

a plurality of threads by which the overlapped portion of said skin forming pieces is over-edge chain stitched with blind over edging along the end edges thereof, to prevent leakage through the end edges; and a foaming material being formed integrally with an inside of said skin forming pieces.

10. A skin foam-in-place skin material as claimed in claim 9, wherein said skin forming pieces are made of moquette skin.

11. A skin foam-in-place skin material as claimed in claim 9, wherein said threads comprises three threads.

12. A skin foam-in-place skin material as claimed in claim 9, wherein the overlapped portion of said skin forming pieces is over-edge chain stitched with blind edging at a stitching pitch ranging from 1.5 to 3 mm.

13. A skin foam-in-place skin material as claimed in claim 9, wherein the overlapped portion of said skin forming pieces is over-edge chain stitched with blind edging at a stitching pitch ranging from 1.5 to 2 mm.

14. A skin foam-in-place skin material according to claim 9, wherein said skin forming pieces are made of moquette skin and is over-edge chain stitched with blind edging by three of said threads using a single needle at a stitching pitch ranging from 1.5 to 3.0 mm.

* * * * *